United States Patent [19]

Yonezawa

[11] Patent Number: 4,850,828

[45] Date of Patent: Jul. 25, 1989

[54] PLUNGER PUMP OF QUICK PRESSURE-RISE TYPE

[75] Inventor: Keitaro Yonezawa, Amagasaki, Japan

[73] Assignee: Kabushiki Kaisha Kosmek, Hyogo, Japan

[21] Appl. No.: 123,552

[22] Filed: Nov. 20, 1987

[30] Foreign Application Priority Data

Nov. 21, 1986 [JP] Japan ..... 61-278963

[51] Int. Cl.[4] ..... F04B 3/00

[52] U.S. Cl. ..... 417/252

[58] Field of Search ..... 417/286, 251, 252, 254, 417/62, 199.2

[56] References Cited

U.S. PATENT DOCUMENTS

| | | | |
|---|---|---|---|
| 1,760,070 | 5/1930 | Kinsella | 417/252 |
| 2,472,802 | 6/1949 | Bentley | 417/199.2 X |
| 2,530,682 | 11/1950 | Coldsnow | 417/251 X |
| 2,653,543 | 9/1953 | Mott | 417/252 X |
| 2,820,415 | 1/1958 | Born | 417/252 X |
| 3,536,421 | 10/1970 | Kemp | 417/251 |
| 3,578,880 | 5/1971 | Cygnor | 417/199.2 X |
| 3,776,665 | 12/1973 | Dalton | 417/252 |
| 4,538,966 | 9/1985 | Nikaido | 417/299 X |

FOREIGN PATENT DOCUMENTS 521244 3/1931 Fed. Rep. of Germany ..... 417/251

*Primary Examiner*—Leonard E. Smith

*Attorney, Agent, or Firm*—Lowe, Price, Leblanc, Becker & Shur

[57] ABSTRACT

In a plunger pump system of a quick pressure-rise type which is utilized for increasing the pressure of a working fluid to be supplied quickly to a hydraulic actuator, such as an oil hydraulic cylinder, both a high pressure plunger pump and a quick-charging pump are connected interlockingly to one prime mover so as to be driven synchronously. During a low pressure range of operation, a large amount of working fluid delivered from a quick-charging plunger chamber is adapted to be supplied to the hydraulic actuator through a high pressure plunger chamber. On the other hand, during a high pressure range of operation, a small amount of high pressure working fluid is adapted to be delivered from the high pressure plunger chamber to the hydraulic actuator. Under this high pressure delivery condition of a small amount of working fluid, the working fluid is adapted to be controlled by a check valve so as to pass through the quick-charging plunger chamber in the regular direction from the suction side to the delivery side thereof.

4 Claims, 4 Drawing Sheets

PLUNGER PUMP OF QUICK PRESSURE-RISE TYPE

BACKGROUND OF THE INVENTION

1. Field of the Invention

The present invention relates to a plunger pump of a quick pressure-rise type utilized for increasing the pressure of working fluid quickly when the working fluid is supplied under pressure to a fluid actuator such as a hydraulic cylinder, which is adapted to be actuated by means of fluid pressure.

2. Background of the Prior Art

Generally, in order to supply the working fluid under pressure to fluid actuator, only one plunger pump is driven operatively by means of a prime mover such as an electric motor, a pneumatic piston engine, the manual power and the like as taught, for example, in to U.S. Pat. No. 4,202,514.

However, there is a disadvantage associated with such prior art, art devices, i.e., it takes a long time to increase the pressure of working fluid to a predetermined value because the load for the plunger pummp increases progressively as the pressure of working fluid rises thereto.

As for a plunger pump which aims to eliminate such a disadvantage, the one shown in FIG. 5 is of a known type. This known prior plunger pump, by the inventor of the present invention, has the following basic construction. A high pressure plunger 52*a* for a high pressure plunger pump 52 and a quick-charging plunger 53*a* for a quick-charging plunger pump 53 are connected interlockingly to one prime mover 54 so as to be driven synchronously. There there is provided an unloader valve 79 in a quick-charging interruption drain passage 78 communicated to a quick-charging plunger chamber 57. A pilot passage 80 for operating the unloader valve 79 is connected to a high pressure delivery passage 74 of a high pressure chamber 58. Until the pressure in the high pressure delivery passage 74 is increased to a predetermined pressure for a quick-charging interruption after the the plungers 52*a*, 53*a* are driven synchronously by the prime mover 54, the unloader valve 79 is kept closed and a large amount of working fluid is adapted to be supplied under a low pressure from both the quick-charging plunger chamber 57 and the high pressure plunger chamber 58 to an actuator chamber 96. When the pressure in the high pressure delivery passage 74 is increased to the predetermined pressure, the unloader valve 79 is opened and the quick-charging plunger chamber 57 is unloaded so that a small amount of working fluid is supplied under a high pressure only from the high pressure plunger chamber 58 thereto.

The plunger pump having such a basic construction functions, for example as shown in FIG. 4, while the pressure in the actuator chamber 96 is increased from the cramping primary stage pressure $P_o$ to the cramping predetermined pressure $P_2$ under the condition that the extension of a cramping oil hydraulic cylinder 95 toward its cramp side is completed.

At the low pressure range A, from the primary pressure $P_o$ to the quick-charging interruption predetermined pressure $P_1$, the working fluid in the actuator chamber 96 is pre-pressurized quickly because a large amount of the working fluid is delivered from both the plungers 52*a*, 53*a*. When the delivery pressure reaches a predetermined pressure $P_1$ and the load is increased, the unloader valve 79 functions so that only the high pressure plunger pump 52 delivers the working fluid under a high pressure to the oil hydraulic cylinder 95. As the result, the delivery amount of the working fluid from the plunger pump 51 becomes less, and the delivery pressure is increased powerfully under a reduced load at the high pressure range B from the quick-charging interruption predetermined pressure $P_1$ to the cramping predetermined pressure $P_2$.

Accordingly, the pressure rising time is shortened by the time which is attained for shortening to the quick pre-pressurization at the low pressure range A.

As shown in FIG. 5, the above-mentioned basic plunger pump has a quick-charging pressure 73 connected to the high pressure delivery passage 74. When the unloader valve 79 operates, the quick-charging interruption drain passage 78 is merely adapted to connect the quick-charging plunger chamber 57 to a working fluid reservoir 98.

There are a number of disadvantages associated with the above-mentioned prior art.

(1) An air removing means is required for removing air from the high pressure plunger chamber 58, because the air mixed with the working fluid as well as intruded through a sealing part such as a seal packing 60 is apt to remain within the high pressure plunger chamber 58 during the non-operation of the plunger pump 51 and to adversely affect the high pressure plunger pump 52, for example so that it takes a long time to increase the delivery pressure or becomes impossible to do that.

When the air removing means is required in order to solve such a problem, the construction of the plunger pump 51 gets complicated by such an added means and, also, the operation thereof gets laborious.

(2) An air removing means is required for removing air from the quick-charging plunger chamber 57.

Since the unloader valve 79 is kept opened during the operation for a small amount of fluid delivery as a high pressure delivery, the quick-charging plunger chamber 57 is supplied with the working fluid also through the quick-charging interruption drain passage 78. As the result, it becomes difficult for the working fluid within the quick-charging plunger chamber 57 to be displaced, and the remaining amount of air increases gradually.

Accordingly, the air removing means is required for prevent the pressure rise from being obstructed by the remaining air at each successive starting. However, the air removing means causes the same troubles as ones mentioned in the item of (1).

(3) Foreign bodies are apt to be sucked into the quick-charging plunger chamber 57.

During the operation of a small amount of flow and high pressure delivery, the working fluid within the reservoir 98 is sucked into the quick-charging plunger chamber 57 through the quick-charging interruption drain passage 78 together with any foreign bodies that may be mixed therewith. As a result, the foreign bodies tend get between the slide surfaces of the quick-charging plunger 53*a* and the high pressure plunger 52*a* and then to scratch the slide surfaces, which may cause pressure leakages thereon as well as increase sliding resistance.

SUMMARY OF THE INVENTION

It is an object of the present invention to enable the omission of an air removing means which functions to remove air from a high pressure plunger chamber in a plunger pump It is another object of the present invention to enable the omission of an air removing means which functions to remove the air from a quick-charging plunger chamber in a plunger pump.

It is still another object of the present invention to prevent foreign bodies from being sucked into a quick-charging plunger chamber of a plunger pump.

In order to accomplish the above-mentioned objects, the present invention is directed to improving the above-mentioned basic construction of a plunger pump.

In a plunger pump according to claim 4 (as hereby amended), there is provided a plunger pump system of a quick pressurized type that includes a high pressure plunger pump with a high pressure plunger, a quick charging plunger pump with a quick charging plunger, both of the plungers being connected interlockingly to a single prime mover to be driven synchronously thereby, and an unloaded valve provided in a quick-charging interruption drain passage, that is connected to a quick-charging plunger changer of the quick-charging plunger pump. A pilot passage is provided to facilitate control of the unloader valve and is connected to a high pressure delivery passage from the high pressure plunger chamber of the high pressure plunger pump. The unloader valve is kept closed while a substantial amount of fluid is delivered under a low pressure from both a quick-charging plunger chamber and a high pressure plunger chamber, until the pressure in the high pressure delivery passage increases to a predetermined quick-charging interruption pressure with both of the plungers being driven synchronously by the prime mover, the unloaded valve being kept open and the quick charging plunger chamber being unloaded when the pressure in the high pressure delivery passage increases to said predetermined quick-charging interruption pressure, so that a small amount of working fluid is delivered under a high pressure only from the high pressure plunger chamber. A quick-charging delivery passage of the quick-charging plunger chamber is connected to a suction passage of the high pressure chamber so that the working fluid delivered from the quick-charging plunger chamber passes through the high pressure plunger chamber during a low pressure delivery of a large amount of working fluid at less than the predetermined quick-charging interruption pressure, and a check valve which is provided in said quick-charging interruption drain passage and an unload passage of the unloader valve so that the working fluid passes through the quick-charging plunger chamber only in the regular direction from the suction side to the delivery side during a high pressure delivery of a small amount of working fluid carried out at and above the predetermined quick-charging interruption pressure, communication holes being provided in a peripheral wall of the high pressure plunger chamber to communicate the quick-charging plunger chamber to the downstream side of the suction passage thereof.

Accordingly, in a device according to the present invention constructed as mentioned above, the following advantages can be obtained.

(1) During a low pressure operation after starting, the air within a high pressure plunger chamber is removed automatically by the working fluid delivered from a quick-charging plunger chamber. Therefore, it is possible to omit an air removing means for the high pressure plunger chamber as well as to save the time and labor for operating the same.

(2) During a high pressure delivery of a small amount of working fluid, since the air that has intruded into quick-charging plunger chamber is removed automatically by the working fluid circulated in the regular direction from the suction side to the delivery side therewithin, it is possible to omit an air removing means for the quick-charging plunger chamber as well as to save the time and labor for operating the same.

(3) Foreign bodies mixed with the working fluid can be prevented from entering into a quick-charging plunger chamber through a quick-charging interruption drain passage. Therefore, the slide surfaces for plungers can be kept smooth so as to prevent the leakage of pressurized fluid as well as to permit an increase is sliding resistance.

The foregoing and other objects and attendant advantages of the present invention will be readily appreciated as the same becomes better understood by reference to the following detailed description when considered with the accompanying drawings, drawings.

BRIEF DESCRIPTION OF THE DRAWINGS

FIG. 1 is a whole system diagram showing an operational condition of a plunger pump of a quick pressure-rise type;

FIG. 2 is a vertical sectional view showing a plunger pump of the quick pressure-rise type;

FIG. 3 is a sectional view on line III—III in FIG. 2;

DESCRIPTION OF THE PREFERRED EMBODIMENT

The preferred embodiment of the present invention will now be explained in detail with reference to the accompanying drawings hereinafter.

Figure 1:
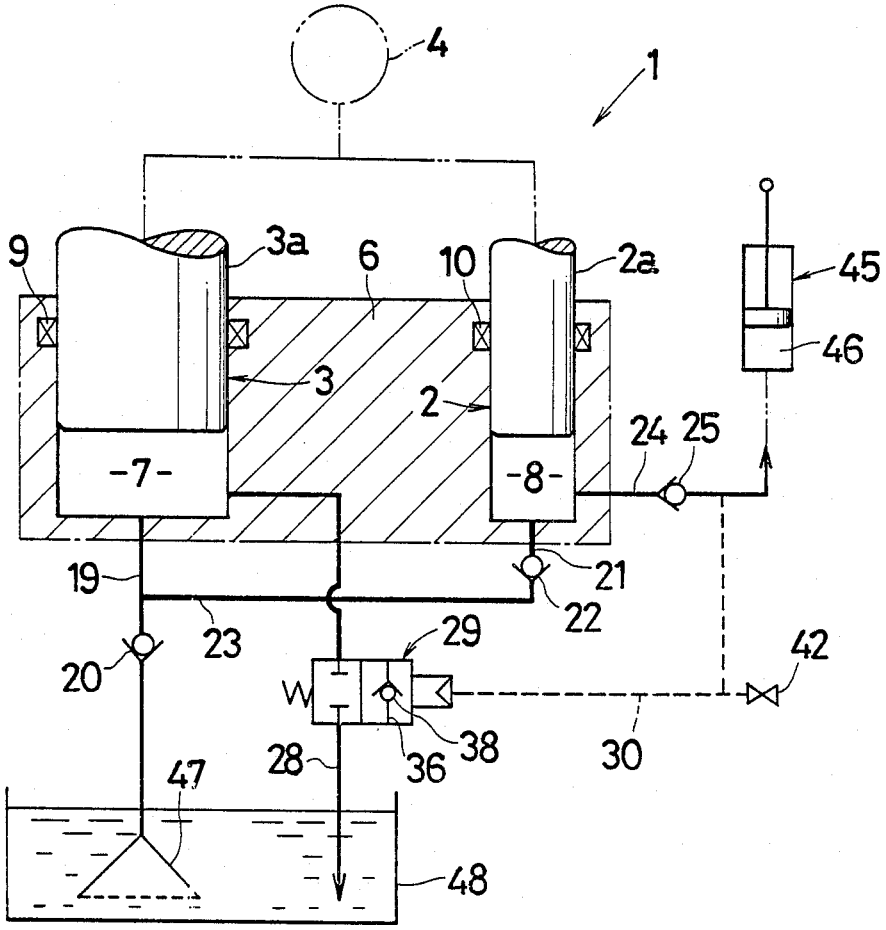
FIGS. 1 through 3 show a preferred embodiment of the present invention.
Figure 2:
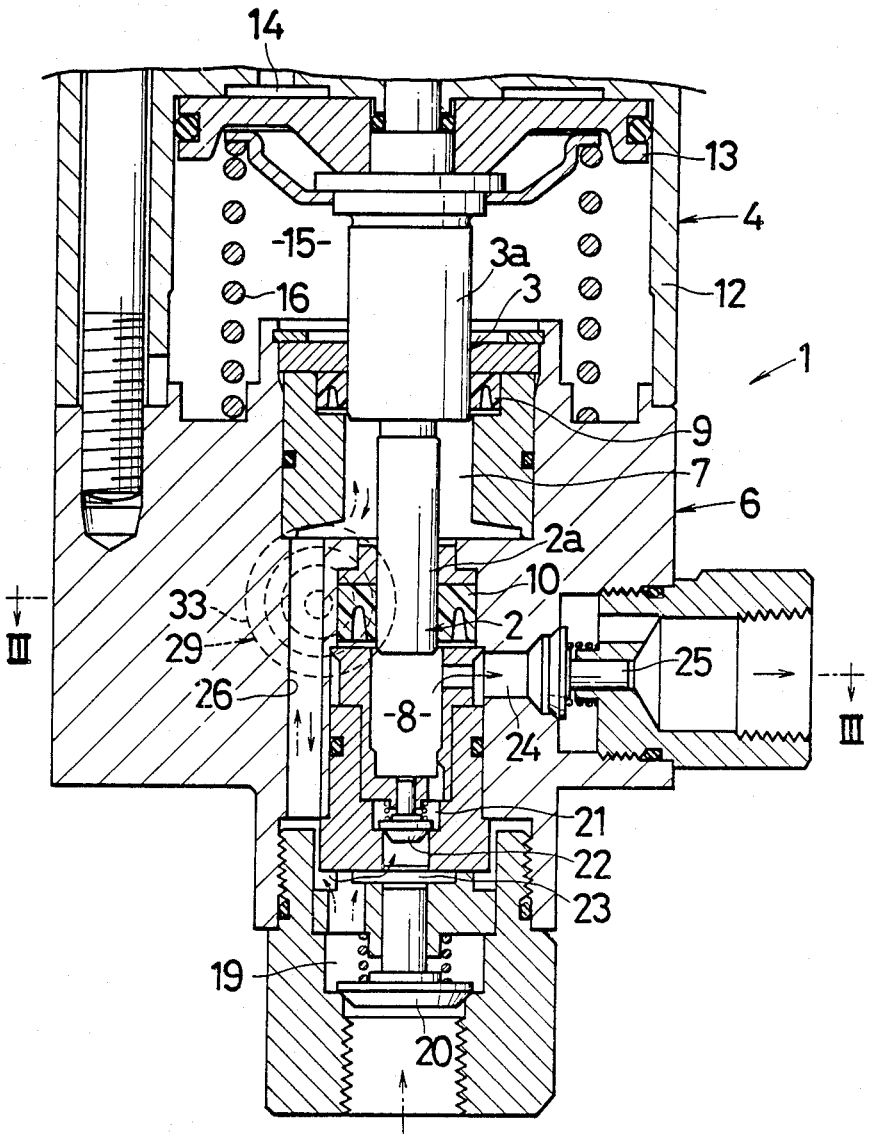
Figure 3:
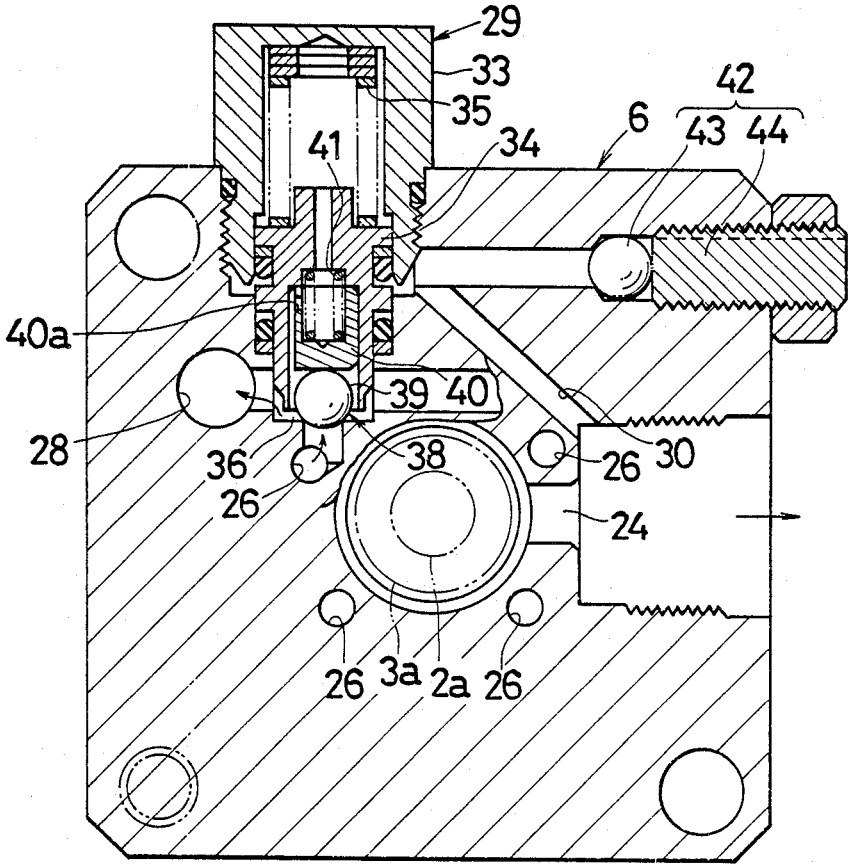
Figure 4:
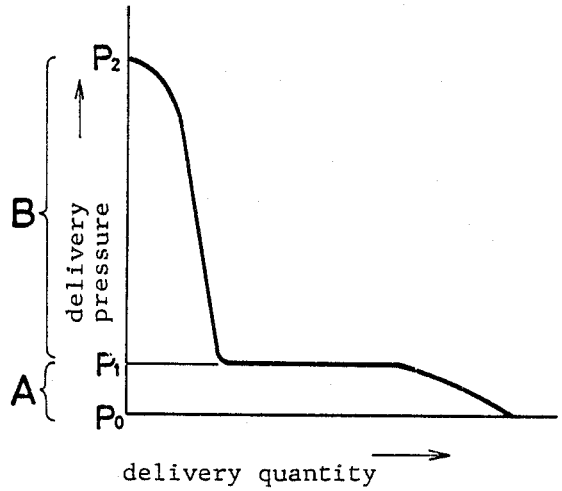
FIG. 4 is a graphical representation, as a performance diagram showing the relation between the delivery quantity and the delivery pressure generally attained by a plunger pump of the quick pressure-rise type.
Figure 5:
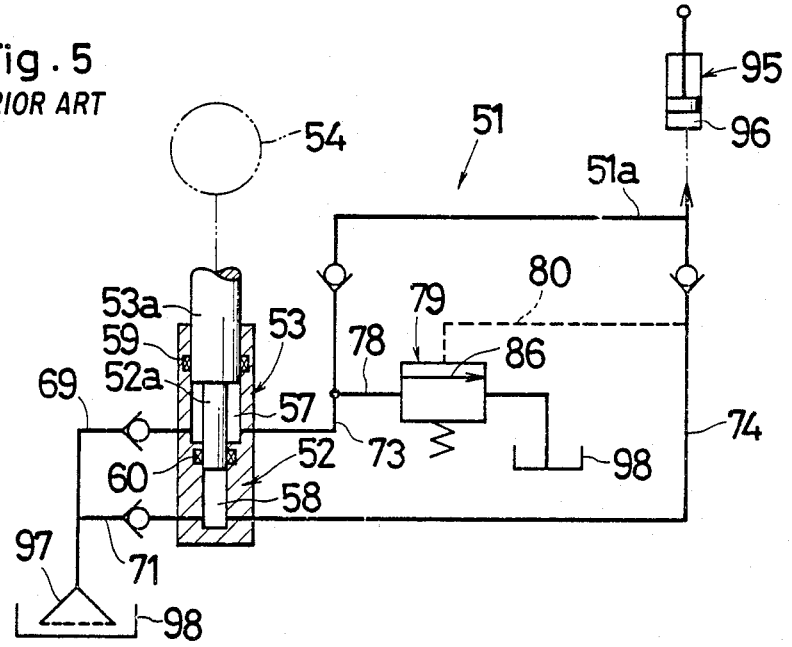
Fig. 5 PRIOR ART
FIG. 5 is a whole system diagram showing an operational condition of a prior art plunger pump in correspondence with FIG. 1.

In FIGS. 1 through 3, the symbol 1 indicates a plunger pump system of a booster type which comprises a dual pump circuit consisting of a high pressure plunger pump 2 and a quick-charging plunger pump 3 combined with each other. A high pressure plunger 2*a* and a quick-charging plunger 3*a* are connected interlockingly to one prime mover 4 so as to be driven synchronously.

A pump body 6 is provided with a quick-charging plunger chamber 7 of a large diameter and a high pressure plunger chamber 8 of a smaller diameter and these which are adapted to be aligned coaxially and vertically in communication with each other. Within the quick-charging plunger chamber 7 there is provided a quick-charging plunger 3*a* which is held vertically slidably and in an oil-tight manner by a sealing packing 9. Within the high pressure plunger chamber 8 there is provided a high pressure plunger 2*a* which is also held vertically slidably and in an oil-tight manner by a sealing package 10. Upper plunger 3*a* and lower plunger 2*a* are connected vertically coaxially each other at best seen in FIG. 2.

The prime mover 4 comprises a pneumatic piston engine which has a cylinder 12 secured to the upper portion of the pump body 6 and a piston 13 held vertically slidably and in an air-tight manner within the cylinder 12. The cylinder 12 is partitioned by the piston 13 to an upper working chamber 14 and a lower spring chamber 15. When the working chamber 14 is supplied with pressurized air, the piston 13 is adapted to be driven downwardly against a return spring 16. When the pressurized air is exhausted from the working 14, the piston 13 is adapted to be returned upwardly by the resilient force of the return spring 16. By repeating the alternation of air supply and air exhaust, the piston 13 is reciprocatively driven. The quick-charging plunger 3*a* is connected to the piston 13 for both plungers 2*a*, 3*a* to be driven together vertically and reciprocatively.

Plunger pumps 2, 3 are explained in greater detail hereinafter.

A suction passage 19 of the quick-charging plunger chamber 7 is connected to be in communication with a fluid reservoir 48 through a strainer 47. At the inlet portion of the suction passage 19, there is provided a suction valve 20, and at a suction passage 21 for the high pressure plunger chamber 8, there is provided a high pressure suction valve 22. The suction passage 19 is connected to the quick-charging plunger chamber 7 through a plurality of communication holes 26 provided in the peripheral wall of the high pressure plunger chamber 8. On the other hand, a quick-charging delivery passage 23 of the quick-charging plunger chamber 7 is connected to the suction passage 21 for the high pressure plunger chamber 8. A high pressure delivery valve 25 is provided at the high pressure delivery passage 24 of the chamber 8. To the downstream side of the high pressure delivery valve 25 is connected, a working chamber 46 of a pressure oil cylinder 45.

A quick-charging interruption drain passage 28 is branched off through the communication holes 26 from the quick-charging plunger chamber 7 and is provided with an unloader valve 29. A pilot passage 30 is connected to the high pressure delivery passage 24 so as to control the unloading of the unloader valve 29. The unloader valve 29 has a cylindrical valve casing 33 threadably secured onto a threaded aperture therefor in the peripheral wall of the pump body 6. A cylindrical piston 34 is put slidably and in an oil tight manner within the bore provided, in the valve casing 33 and the pump body 6, and is resiliently pushed toward the valve closing position by a valve closing spring 35 provided within the valve casing 33. One end of the pilot passage 30 is connected to the bore for the piston 34 at an intermediate point in the axial range of the movement of piston 34 so that the piston 34 can be pushed toward the valve opening position by the pressure from the high pressure delivery passage 24.

Further, in the unloader passage 36 of the unloader valve 29, there is provided a check valve 38 for blocking a counter-flow from the fluid reservoir 48. The check valve 38 has a spherical valve body 39 which is resiliently pushed toward the valve closing position by a push spring 41 through a holder 40 within a cylindrical hole provided in the piston 34. The opposite portions of the bore for the piston 34 are connected in communication with each other through a flow passage 40*a* formed in the holder 40. In FIG. 3, the symbol 42 indicates an air vent valve which is adapted to be operated manually so as to remove air at the commencement of the utilization of the plunger pump system 1 and comprises a valve body 43 and a screw plug 44.

The functions of the present invention are summarized hereinafter.

(1) During the non-operation of the plunger pump 1, air tends to gather and remain within the high pressure plunger chamber 8.

At the low pressure delivery operation of the plunger pump system 1 after its starting, a large amount of working oil is delivered from the quick-charging plunger chamber 7 to the high pressure plunger chamber 8 and the air that has remained within the high pressure plunger chamber 8 is removed automatically by this large amount of the working oil flowing in. As a result, the delivery performance of the high pressure plunger pump 2 is not adversely affected by the air and the pressure of the working oil is increased powerfully.

(2) During the high pressure delivery of a small amount of working oil, air tends to intrude into the quick-charging plunger chamber 7 which is kept at a relatively low pressure.

Since the air intruded thereinto is removed automatically by the working oil circulated in the regular direction within the quick-charging plunger chamber 7, this air does not remain within the chamber 7. As a result, the pressure of the working oil is increased powerfully even at an early stage of the next starting of the pump system 1.

(3) During the high pressure delivery of a small amount of the oil, since the working oil is adapted to pass through the quick-charging plunger chamber 7 only in the regular direction, any foreign bodies mixed with the working oil within the working oil reservoir 48 are not conveyed into the the quick-charging plunger chamber 7 through the quick-charging interruption drain passage 28. Therefore, such foreign bodies are prevented from getting in between the slide surfaces of the quick-charging plunger 3*a* and the high pressure plunger 2*a*, and this helps to keep the slide surfaces smooth and to solve such problems as pressure leakage and an increase of slide resistance.

Incidentally, as for the prime mover 4 in the above-mentioned embodiment, the pneumatic piston engine may be replaced with a pressurized oil type engine, and an internal combustion engine or the like.

Further, the check valve 38 may be disposed at the quick-charging interruption drain passage 28 or at both passages 28, 36 respectively, instead of at the unloader passage 36 of the unloader valve 29.

Instead of oil, other kinds of fluid such as water may be utilized as the working fluid.

I claim:

1. A plunger pump system of a quick pressure-rise type, comprising:

a high pressure plunger pump with a high pressure plunger;

a quick-charging plunger pump with a quick-charging plunger, both of said plungers being connected interlockingly to one prime mover so as to be driven synchronously;

an unloader valve, provided in a quick-charging interruption drain passage connected to a quick-charging plunger chamber of the quick-charging plunger pump;

a pilot passage for facilitating control of said unloader valve connected to a high pressure delivery passage of a high pressure plunger chamber of the high pressure plunger pump, said unloader valve being kept closed while a substantial amount of working fluid is delivered under a low pressure from both the quick-charging plunger chamber and the high pressure plunger chamber until the pressure in the high pressure delivery passage increases to a predetermined quick-charging interruption pressure with both of said plungers driven synchronously by the prime mover, the unloader valve being opened and the quick-charging plunger chamber being unloaded when the pressure in the high pressure delivery passage increases to said predetermined quick-charging interruption pressure so that a small amount of working fluid is delivered under a high pressure only from the high pressure plunger chamber, a quick-charging delivery passage of said quick-charging plunger chamber being connected to a suction passage of said high pressure plunger chamber so that the working fluid delivered from the quick-charging plunger chamber passes through the high pressure plunger chamber during a low pressure delivery of a large amount of working fluid carried out below the predetermined quick charging interruption pressure; and a check valve being provided in said quick-charging interruption drain passage and an unload passage of said unloader valve so that the working fluid passes through the quick-charging plunger chamber only in the regular direction from the suction side to the delivery side during a high pressure delivery of a small amount of working fluid carried out at and above the predetermined quick-charging interruption pressure wherein communication holes are provided in a peripheral wall of the high pressure plunger chamber so as to communicate the quick-charging plunger chamber to the downstream side of the suction passage thereof.

2. A plunger pump system as recited in claim 1, wherein:

the check valve is provided in the unload passage of the unloader valve.

3. A plunger pump system as recited in claim 1, wherein:

a valve casing of the unloader valve is secured onto a pump body of the plunger pump system, a cylindrical piston is located within the valve casing slidably and in an oil-tight manner and is resiliently pushed toward a valve closing position by a valve closing spring, and a valve face of the unloader valve is formed by a valve body of the check valve provided within the cylindrical hole of the cylindrical piston.

4. A plunger pump system as recited in claim 1, wherein:

the prime mover comprises a pneumatic piston engine of which piston is interlockingly coupled to the quick-charging plunger of the quick-charging plunger pump.

* * * * *